US007818937B2

(12) United States Patent
Monsieur

(10) Patent No.: US 7,818,937 B2
(45) Date of Patent: Oct. 26, 2010

(54) ROOF PANEL

(76) Inventor: René Hermann Monsieur, Römerweg 54, D-67434 Neustadt/Wstr. (DE)

( * ) Notice: Subject to any disclaimer, the term of this patent is extended or adjusted under 35 U.S.C. 154(b) by 628 days.

(21) Appl. No.: 11/061,053

(22) Filed: Feb. 19, 2005

(65) Prior Publication Data

US 2006/0059836 A1 Mar. 23, 2006

(30) Foreign Application Priority Data

Feb. 20, 2004 (DE) ..... 20 2004 002 827 U

(51) Int. Cl.
*E04D 1/00* (2006.01)

(52) U.S. Cl. ..... 52/531; 52/525; 52/538; 52/545

(58) Field of Classification Search ..... 52/588.1, 52/520, 522, 524–527, 531, 537–538, 543, 52/545, 547
See application file for complete search history.

(56) References Cited

U.S. PATENT DOCUMENTS 3,394,524 A * 7/1968 Howarth ..... 52/588.1
3,508,368 A * 4/1970 Keys et. al. ..... 52/394
3,511,011 A * 5/1970 Straus ..... 52/478
3,555,758 A * 1/1971 Schroter ..... 52/309.9
3,708,943 A * 1/1973 Thomas et al. ..... 52/309.8
4,918,898 A * 4/1990 McLeod, Jr. ..... 52/588.1
4,987,716 A * 1/1991 Boyd ..... 52/520
5,001,881 A * 3/1991 Boyd ..... 52/545
5,074,567 A * 12/1991 Orlowski ..... 277/347
5,247,772 A * 9/1993 Greenberg ..... 52/531
5,259,166 A * 11/1993 Carey et al. ..... 52/749.12
5,287,671 A * 2/1994 Ueki ..... 52/588.1
5,355,649 A * 10/1994 Berridge ..... 52/520
5,535,567 A * 7/1996 Cahoon ..... 52/520
7,021,023 B2 * 4/2006 Rood, Jr. ..... 52/748.1

* cited by examiner

*Primary Examiner*—Richard E Chilcot, Jr.
*Assistant Examiner*—Chi Q Nguyen
(74) *Attorney, Agent, or Firm*—Muncy, Geissler, Olds & Lowe PLLC

(57) ABSTRACT

A roof panel is furnished with a flat covering element (1) having a front edge, a rear edge, a first side and a second side, a projecting bent-up side face (2) vertically protruding from the flat covering element (1) near the first side, and a bent-up side face (4) vertically bending off at the second side of the flat covering element (1). An inwardly flanged edge (3) is formed at the projecting bent-up side face (2) bent over toward the inside. An outwardly crimped edge (5) is formed at the bent-up side face (4) bent over toward the outside. A single piece connected attachment edge (7) for screw holes is disposed along the projecting bent-up side face at the outer side of the projecting bent-up side face. An upwardly warped reinforcement bead (8) is extending parallel to the first side and to the second side and subdividing the flat covering element (1).

18 Claims, 5 Drawing Sheets

ROOF PANEL

BACKGROUND OF THE INVENTION

1. Field of the Invention

The subject matter of the present Invention refers to a roof panel.

2. Brief Description of the Background of the Invention Including Prior Art

Conventional roof panels have a substantial weight and therefore represent a substantial load for the roof truss.

SUMMARY OF THE INVENTION

1. Purposes of the Invention

It is an object of the present Invention to furnish a roof panel which is light weight.

It is another object of the present Invention to furnish a roof panel which continuously leads the water from the top of the roof to the gutter.

It is yet another object of the present Invention to furnish a roof panel which can be easily and without difficulty assembled.

These and other objects and advantages of the present invention will become evident from the description which follows.

2. Brief Description of the Invention

The present invention provides a roof panel comprising a flat covering element having a front edge, a rear edge, a first side and a second side, a projecting bent-up side face vertically protruding from the flat covering element near the first side, and a bent-up side face vertically bending off at the second side of the flat covering element. An inwardly flanged edge is formed at the projecting bent-up side face bent over toward the inside. An outwardly crimped edge is formed at the bent-up side face bent over toward the outside.

A single piece connected attachment edge for screw holes is disposed along the projecting bent-up side face at the outer side of the projecting bent-up side face. An upwardly warped reinforcement bead is extending parallel to the first side and to the second side and subdividing the flat covering element.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
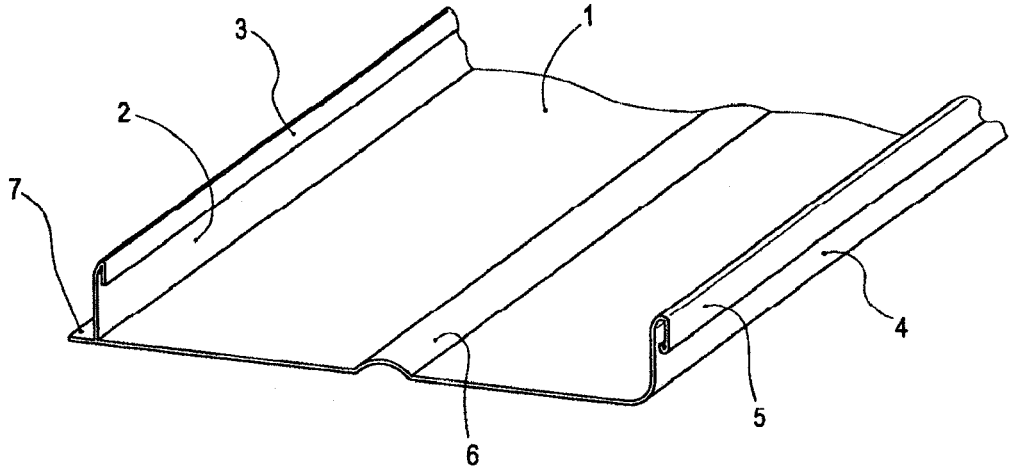
FIG. 1 is a perspective view of a section of a roof panel.
Figure 2:
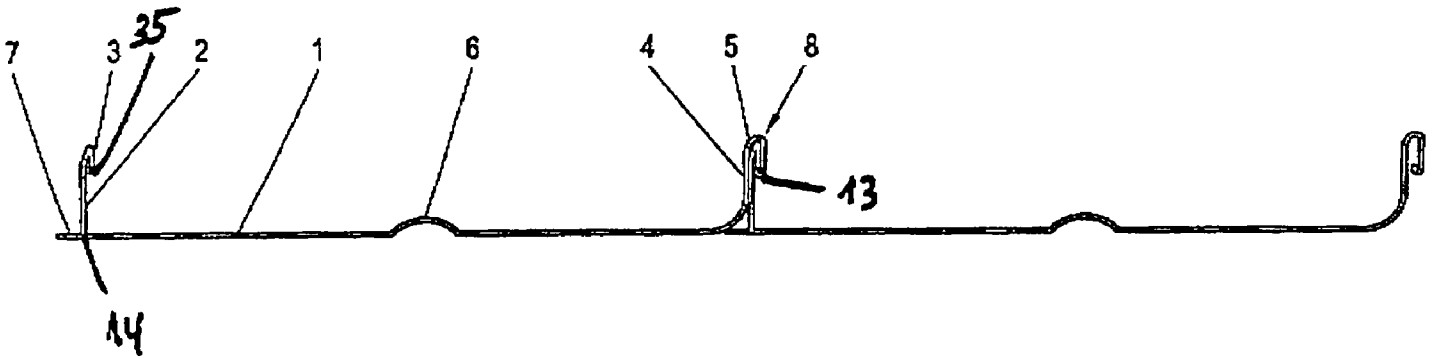
FIG. 2 is a front elevational view of two roof panels joint together.

The roofing panel of the present at Invention represents a roof covering element which comprises plastic. The plastic can be any plastic capable of withstanding the weather and the elements. Such plastics include polyethylene, polypropylene, and polyvinyl chloride. The flat covering element exhibits on one side an offset side face. The offset side face in turn is furnished with an edge bead, wherein the edge bead points to the base face of the roof covering element. The flat covering element has an oppositely disposed side face with a flanged edge, wherein the flanged edge is pointing away from the covering element base face. The plastic can preferably exhibits as selected elasticity and also hardness.

The plastic material can comprise polyethylene. The modulus of elasticity can be from 15,000 to 160,000 psi. The tensile strength can be from 1000 to 5,500 psi. The ultimate elongation can be from 15 to 700 percent. The yield stress can be from 1,100 to 5000 psi. The yield strain can be from 5 to 40 percent. The Rockwell hardness can be from R 30 to R 50. The notched Izod impact strength can be from 0.5 to 20 ft lb/in. The specific gravity can be from about 0.91 to 0.965.

The plastic material can comprise polypropylene. The modulus of elasticity can be from 1,400 to 1,700 psi. The tensile strength can be from 2,900 to 4,500 psi. The ultimate elongation can be from 200 to 700 percent. The yield stress can be from 3,000 to 4900 psi. The yield strain can be 15 percent and higher. The Rockwell hardness can be from R 50 to R 96. The notched Izod impact strength can be from 1 to 12 ft lb/in. the specific gravity can be from about 0.89 to 0.91.

The plastic material can comprise poly vinyl chloride. The modulus of elasticity can be from 200,000 to 600,000 psi. The tensile strength can be from 1,500 to 9,000 psi. The ultimate elongation can be from 2 to 400 percent. The yield strain can be from 1 to 5 percent. The Rockwell hardness can be from R 110 to R 120. The notched Izod impact strength can be from 0.4 to 2 ft lb/in. The specific gravity can be from about 1.15 to 1.4.

The advantages of this new roof panel can be easily split up into a plurality of individual advantages; individual advantages are a continuous leading of water from the top of the roof to the gutters is achieved.

the light weight construction of for example 4 kg/square meter represents both an easy transport work to the construction site as well as also in particular a low load of the roof truss or woodwork of the roof.

the mounting and assembly is simple and easy, for example on a ruled under construction, since the assembly can be performed according to the so-called click system representing a click-stop engagement, that is the individual roof panels according to the present Invention can be connected elegantly and quickly with a so-called click closure.

a further advantage comprises that no butt joints exist in contrast for example to the state-of-the-art employing corrugated roof slabs, whereby all disadvantages of the butt joints and in particular the leakage danger of the butt joints are avoided. The roof panel according to the present Invention furnishes an absolute waterproof and watertight connection impermeable to any rainwater.

a further advantage of the subject matter of the present Invention comprises that the roof panels according to the present Invention do not need any support clamps or other support elements.

The profile according to the present Invention is particularly well-suited for car ports, overhanging roofs, garden houses, stables, cow sheds, utility buildings, parking garages, parking sheds and the generally at places having a covering roof, which have a small extension for static reasons. Here again the comparably small weight represents a jump in comparison with the state-of-the-art and plays an advantageous role.

According to a preferred embodiment the panels can be furnished on a side disposed parallel to one of the two above recited side faces with an attachment edge for screws or for similar attachment elements.

According to a further preferred embodiment the base face of the roof panel exhibits preferably an upwardly warping reinforcement disposed in the middle of the roof panel.

The features of the present Invention are furthermore illustrated by way of the associated FIG. 1, which represents a preferred embodiment of the invention subject.

FIG. 1 shows a broken off representation.

The flat covering element designated with reference numeral 1. The projecting bent up side face having an inwardly flanged edge 3 is associated with reference numeral 2. Reference numeral 4 designates the bent-up side face disposed on an opposite side and having an outwardly crimped edge 5.

The upwardly warped reinforcement bead in the middle is designated with the reference numeral 6.

An attachment edge for screws is designated with the reference numeral 7. The attachment edge 7 is disposed parallel and perpendicular at the outer side of the projecting bent-up side face 2 as a single piece construction.

Figure 5:
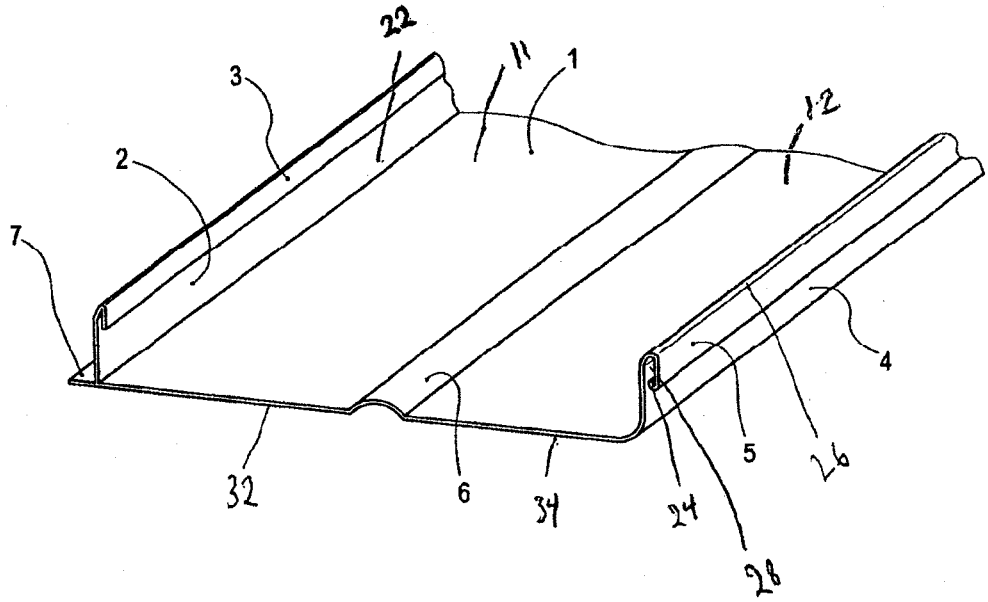
FIG. 5 is a view similar to FIG. 1, however with more detailed designations.

The preferred embodiment shown in FIG. 5 shows a first rectangular flat piece 11 and a second rectangular flat piece 12 disposed in a plane and joined by the upwardly warped reinforcement bead 6. The projecting bent up side face 2 comprises a flat ledge 22 rising vertically from the first rectangular flat piece 11 at the side disposed oppositely to the joining with the upwardly warped reinforcement bead 6 and a bending over of the upper end of the flat ledge 22 in the direction of the upwardly warped reinforcement bead 6 and ending in the inwardly flanged edge 3. An attachment edge 7 represents an extension of the first rectangular flat piece 11 beyond the position of joining with the flat ledge 22.

The second rectangular flat piece 12 is bent upwardly on the side opposite to the joining with the upwardly warped reinforcement bead 6 and ends in the bent-up side face 4. The height of the bent up side face 4 can be slightly higher than the projecting bent-up side face 2 by about from one to two times the thickness of the material of the bent-up side face 4.

An outwardly crimped edge 5 is formed at the top of the bent-up side face and hangs down on the outside of the bent-up side face 4. The distance of the inner side of the outwardly crimped edge 5 to the outer side of the bent-up side face 4 can be from about one to two times the distance in a horizontal direction of the outer side of the flat ledge 22 to the relative remote side of the inwardly flanged edge 3.

The outwardly crimped edge 5 has at its bottom a locking bead projection 24 directed toward the bent-up side face 4. The locking bead projection 24 is disposed at or below the horizontal level of the lower edge of the inwardly flanged edge 3 for locking with an inwardly flanged edge 3 of a neighboring roof panel. The distance from the upper side of the locking bead projection 24 to the bottom side of the upper connection of bent-up side face 4 to the outwardly crimped edge 5 should be larger than the top-bottom extension of the inwardly flanged edge 3. In other words, the inwardly flanged edge 3 is to be such dimensioned that the inwardly flanged edge 3 lockingly fits into the free space 28 left above the locking bead projection 24.

Figure 3:
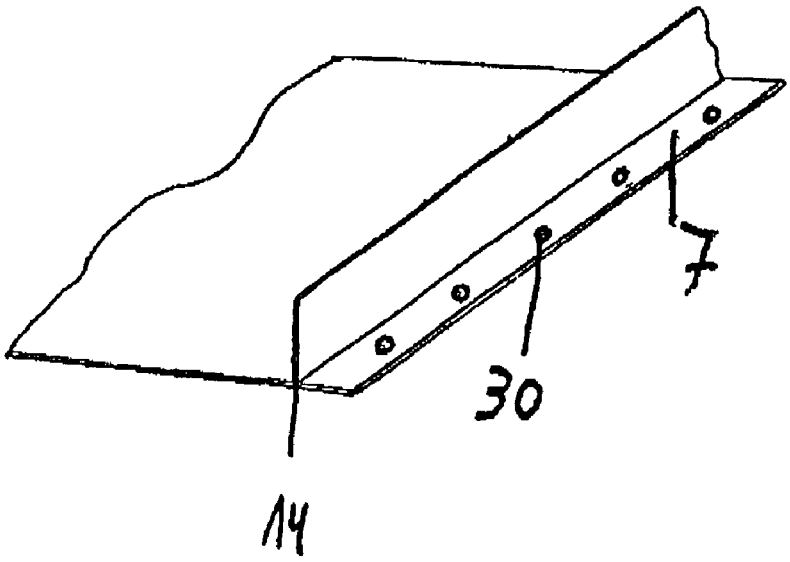
FIG. 3 is a view from the top showing the screw holes in the ledge.
Figure 4:
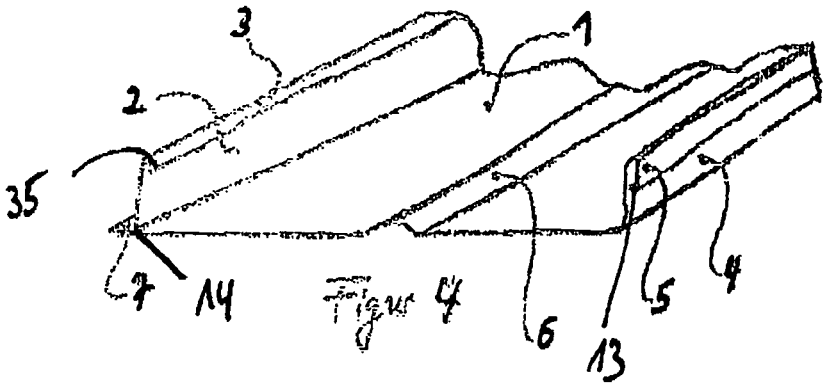
FIG. 4 is another perspective view of a roofpanel according to the present invention.

The attachment ledge 7 can be furnished with perforations 30 for attachment of the roof panel to the roof truss. The hole perforations 30 are shown in FIG. 3 and can ease an attachment of the roof panel to the roof truss with screws or nails.

The roof panel is shown with straight front edges of the first rectangular flat piece 11 and of the second rectangular flat piece 12. Alternatively, the front edges can have any other suitable configuration for a roof panel. Similarly, the rear edges of the first rectangular flat piece 11 and of the second rectangular flat piece 12 can be straight or have any configuration suitable for a roof panel. The front to rear dimension of the roof panel can be larger than the side to side extension and can be more than two times or more than three times.

The width of the roof panel can be from about 3 to 20 times the height of the projecting bent-up side face 2 or of the height of the bent-up side face 4 and is preferably from about 6 to 10 times the height of the projecting bent-up side face 2 or of the height of the bent-up side face 4.

The height of the projecting bent-up side face 2 or of the height of the bent-up side face 4 can be from 1 to 5 times the width of the attachment ledge 7 and is preferably from 1.5 to 3 times the width of the attachment ledge 7.

The height of the projecting bent-up side face 2 can be from about 2 to 4 times the vertical extension of the inwardly flanged edge 3. The height of the bent-up side face 4 can be from 2 to 4 times the outwardly crimped edge 5.

It will be understood that each of the elements described above, or two or more together, may also find a useful application in other types of covering system configurations and water proofing procedures differing from the types described above.

While the invention has been illustrated and described as embodied in the context of a roof panel, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A roof panel made out of plastic comprising a flat covering element having a front edge, a rear edge, a first side edge, a second side, an upper surface and a lower surface;

a wall extending from the upper surface of the flat covering element near the first side edge the lower surface of the flat covering element extending continuously below the wall, the wall including a flange on a side of the wall facing the covering element second side edge;

a vertical bent-up side face bending off at the second side of the flat covering element;

and an outwardly crimped edge formed at the bent-up side face bent over toward an outside, wherein an ending portion of the outwardly crimped edge forms a hook-like structure.

2. A roof panel comprising:

a covering element having a front edge, a rear edge, a first side having an edge, a second side, a central portion between said first side and said second side, an upper surface and a lower surface;

a first wall extending from said upper surface of said covering element at a first distance from said first side edge, said first wall having a first side facing away from said central portion and a second side facing toward said central portion, said first wall having an end portion doubled over said first wall second side, said lower surface of said flat covering element extending continuously below said first wall;

said second side of said covering element curving away from said central portion to form a second wall having an upstanding portion having a first side, comprising a portion of said covering element upper surface, facing said central portion and being generally parallel to said first wall first side, and a second side, comprising a portion of said covering element lower surface, facing away from said central portion, a first end portion of said second wall being doubled over said second wall second side and a second end portion of said second wall extending between said first end portion of said second wall and said second wall upstanding portion second side.

3. The roof panel of claim 2 including a gap between said second wall upstanding portion and said second wall second end portion.

4. The roof panel of claim 2 including a gap between said first end portion of said second wall and said second end portion of said second wall.

5. The roof panel of claim 2 including a first gap between said second wall upstanding portion and said second wall second end portion and a second gap between said second wall first end portion and said second wall second end portion.

6. The roof panel of claim 5 wherein said first gap has a width greater than a width of said first wall doubled-over end portion.

7. The roof panel of claim 5 wherein said second gap has a width greater than a thickness of said first wall.

8. The roof panel of claim 2 wherein said central portion includes an arcuate reinforcing rib running parallel to said first wall.

9. The roof panel of claim 2 wherein said central portion includes a planar portion extending from said first wall and an arcuate rib between said planar portion and said second wall running parallel to said first wall.

10. The roof panel of claim 2 wherein said first wall doubled-over end portion is generally parallel to said second wall first end portion.

11. A roof member comprising a plurality of interconnected roof panels including a primary panel and a secondary panel, said primary roof panel and said secondary roof panel each comprising:

a covering element having a front edge, a rear edge, a first side having an edge, a second side, a central portion between said first side and said second side, an upper surface and a lower surface;

a first wall extending from said upper surface of said covering element at a first distance from said first side edge, said first wall having a first side facing away from said central portion and a second side facing toward said central portion, said first wall having an end portion doubled over said first wall second side, said lower surface of said flat covering element extending continuously below said first wall;

said second side of said covering element curving away from said central portion to form a second wall having an upstanding portion having a first side, comprising a portion of said covering element upper surface, facing said central portion and being generally parallel to said first wall first side, and a second side, comprising a portion of said covering element lower surface, facing away from said central portion, a first end portion of said second wall being doubled over said second wall second side and a second end portion of said second wall extending between said first end portion of said second wall and said second wall upstanding portion second side;

wherein said doubled over end portion of said first wall of said secondary roof panel projects between said second side of said second wall of said primary roof panel and said second end portion of said second wall of said primary roof panel.

12. The roof member of claim 11 wherein an end edge of said doubled over portion of said first wall of said secondary roof panel faces a junction of said second wall first end portion of said primary roof panel and said second wall second end portion of said primary roof panel.

13. The roof member of claim 11 wherein an end edge of said doubled over portion of said first wall of said secondary roof panel extends into a second gap between said second wall first end portion of said primary roof panel and said second wall second end portion of said primary roof panel.

14. The roof member of claim 11 wherein said primary panel second wall includes an arcuate portion overlying said first side edge of said secondary panel.

15. The roof member of claim 11 wherein said primary panel second wall includes an arcuate portion contacting said first side edge of said secondary panel.

16. The roof member of claim 11 wherein said second wall second end portion of said primary panel contacts said second side of said first wall of said secondary panel.

17. The roof member of claim 11 wherein said first wall runs from said front edge to said rear edge.

18. The roof panel of claim 11 wherein said first wall doubled-over end portion is generally parallel to said second wall first end portion.

* * * * *